United States Patent [19]

Burke

[11] Patent Number: 4,932,127

[45] Date of Patent: Jun. 12, 1990

[54] HAND TOOLS CONVERTIBLE FOR CHOPPING AND SPLITTING

[76] Inventor: Edward R. Burke, P.O. Box 121, Glen Mills, Pa. 19342

[21] Appl. No.: 223,460

[22] Filed: Jul. 22, 1988

[51] Int. Cl.[5] ..... B26B 3/00

[52] U.S. Cl. ..... 30/308.1; 30/308.2; 30/308.3; 144/193 D

[58] Field of Search ..... 30/308.1, 308.2, 308.3; 144/193 R, 193 C, 193 D, 193 E; 254/104

[56] References Cited

U.S. PATENT DOCUMENTS

| | | | |
|---|---|---|---|
| D. 26,335 | 11/1896 | Barbour . | |
| D. 255,141 | 9/1982 | Nannen . | |
| D. 266,902 | 11/1982 | Tarran . | |
| D. 271,076 | 10/1983 | Hillinger . | |
| D. 277,545 | 2/1985 | Newmeyer et al. . | |
| 424,205 | 3/1890 | Hufford . | |
| 561,000 | 5/1896 | Karns . | |
| 653,234 | 7/1900 | Graham . | |
| 746,783 | 12/1903 | Blount . | |
| 1,118,010 | 11/1914 | Huhn . | |
| 1,404,660 | 1/1922 | Shugart . | |
| 1,504,644 | 8/1924 | Rayburn . | |
| 1,729,365 | 9/1929 | Sells . | |
| 4,044,808 | 8/1977 | Kolonia . | |
| 4,181,166 | 1/1980 | Jones . | |
| 4,268,965 | 5/1981 | Askew . | |
| 4,300,606 | 11/1981 | Branson . | |
| 4,357,974 | 11/1982 | Mannen . | |
| 4,372,360 | 2/1983 | Eichlin . | |
| 4,382,459 | 5/1983 | Bartok . | |
| 4,383,562 | 5/1983 | Hockman . | |
| 4,440,205 | 4/1984 | Hillinger . | |
| 4,445,555 | 5/1984 | Klempirik | 144/193 D |
| 4,509,573 | 4/1985 | Santmyer, Jr. | 144/193 D |
| 4,522,240 | 6/1985 | Green et al. . | |
| 4,586,258 | 5/1986 | Burke . | |

FOREIGN PATENT DOCUMENTS

| | | |
|---|---|---|
| 43609 | 9/1931 | Denmark . |
| 12741 | 7/1901 | Sweden . |
| 79336 | 1/1934 | Sweden . |

*Primary Examiner*—Frederick R. Schmidt
*Assistant Examiner*—M. Rachoba
*Attorney, Agent, or Firm*—Panitch, Schwarze, Jacobs & Nadel

[57] ABSTRACT

A hand tool convertible for chopping and splitting comprises a head including a blade end with a cutting edge, an eye hole extending in an axial direction through the head for receiving a handle, a pair of opposing major side faces extending from the cutting edge around and past the eye hole, and a recess extending into at least one of the pair of side faces, and a wedge element removably received in the recess. In the preferred embodiments the wedge element is asymmetrically positioned with respect to any other wedge elements that may be attached to the head and is generally non-movably mounted to the head by a stud portion received in a recess in the head.

22 Claims, 2 Drawing Sheets

HAND TOOLS CONVERTIBLE FOR CHOPPING AND SPLITTING

FIELD OF THE INVENTION

The invention relates to hand tools and, in particular, to axes, hatchets and the like typically used for chopping which are convertible into tools like mauls for splitting.

Conventional hand tools used for chopping like axes and hatchets typically include a generally symmetrically-shaped head. So do conventional hand tools like mauls used for splitting. The symmetry allows the tool to be used left-handedly or right-handedly with equal ease and response.

A number of variations have been proposed for enhancing the wood splitting capabilities of axes and mauls. Many variations include movable parts designed to swivel or rotate to spread the wood and/or to ease the passage of the tool through the wood. Other variations include solid heads with protrusions formed on opposing side faces. Both constructions increase the cost and limit the tool's ability to be easily used for chopping.

Applicant's U.S. Pat. No. 4,586,258 discloses an ax having an asymmetrically configured head which enhances the ability of the ax to split wood. The invention described in that patent offers a relatively simple alternative to the more complicated tool constructions mentioned above to enhance the splitting characteristics of the tool. The patent depicts such a tool designed for a right-handed user. A tool preferred for a left-handed user would have a head curving in an opposite (mirror image) direction. Thus, two variations (left and right hand) must be manufactured and stocked to fully satisfy the market for this invention.

SUMMARY OF THE INVENTION

The present invention is directed to a hand tool convertible for chopping and splitting which comprises a head including a blade end with a cutting edge, an eye hole extending in an axial direction through the head for receiving a handle, a pair of opposing major side faces extending from the cutting edge around and past the eye hole, and a recess extending into at least one of the pair of side faces. The hand tool further comprises a wedge element including a protruding stud portion, the stud portion being removably retained in the first recess and at least generally non-movably connecting the wedge element to the head protruding from the one side face. The invention also comprises the cutting tool head adaptable to receive one or more wedges, wedge inserts for cutting tool heads, and various combinations of one or more wedges with cutting tool heads.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings, embodiments which are presently preferred, it being understood, however, that the invention is not limited to the precise arrangements and instrumentalities shown.

In the drawings.

DESCRIPTION OF PREFERRED AND OTHER EMBODIMENTS

Figure 1:
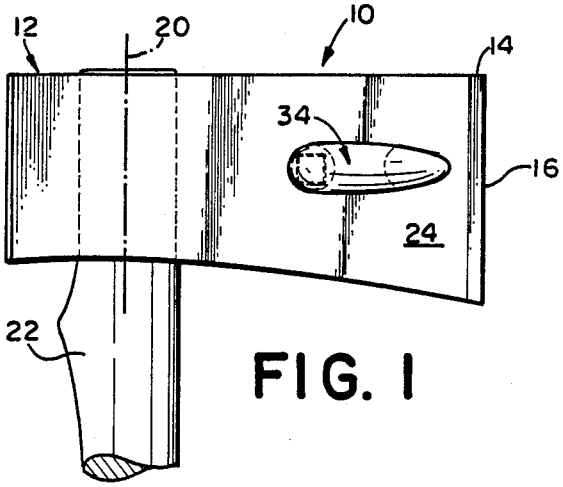
FIG. 1 is a side elevation view of a first embodiment hand tool of the invention configured for splitting.
Figure 2:
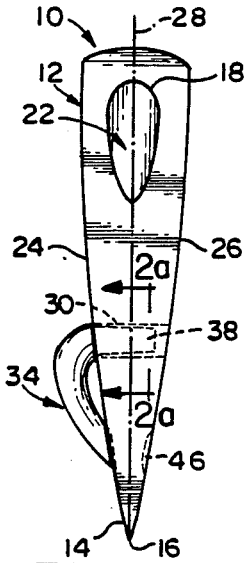
FIG. 2 is a top plan view of the tool of FIG. 1.
Figure 3:
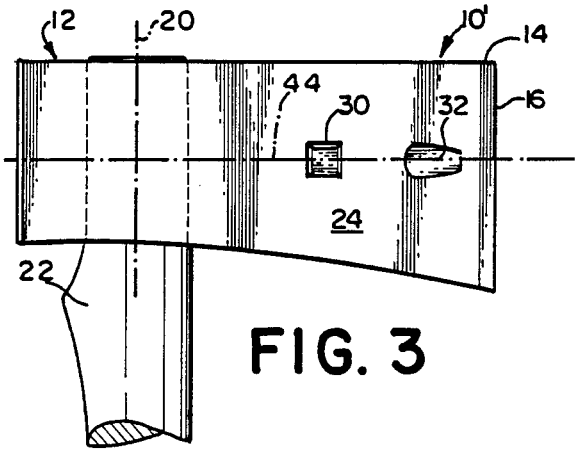
FIG. 3 is a side elevation view of the tool of FIGS. 1 and 2 configured for chopping.

In the various figures, like numbers are used to indicate like elements. FIGS. 1 through 5 depict in assembled and disassembled form, the various components of a first embodiment hand tool of the invention, preferred for its simplicity. FIGS. 1 through 2 depict diagrammatically the hand tool, designated at 10, configured for splitting. FIG. 3 depicts the same tool, configured for chopping and denoted as 10'. Each configuration 10 and 10' includes a head 12 having a blade end 14 with a cutting edge 16, an eye hole, the outline of which is indicated at 18 in FIG. 2, extending in an axial direction, indicated by axis 20 in FIGS. 1 and 3, through the head 12 for receiving a handle 22 (only partially depicted in FIGS. 1 and 3). The head 12 is joined to the handle 22 in a conventional manner which may be, for example, the driving of a wedge or wedges (not depicted) into the upper end of the handle 22 extending through the eye hole 18. The head 12 further includes a pair of opposing major side faces 24 and 26, both seen in FIG. 2, extending from the cutting edge 16 around and past the eye hole 18. A central plane 28, depicted in FIG. 2 and in the plane of FIGS. 1 and 3, extends between the pair of side faces 24 and 26, bisecting the cutting edge 16 and eye hole 18. As is best seen in FIG. 3, a first recess 30 and second recess 32 are provided in the head 12 extending into side face 24.

Figure 4:
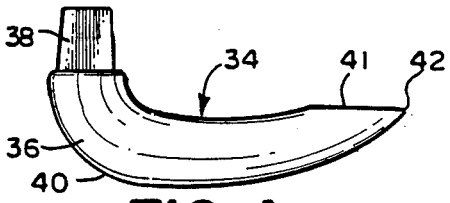
FIG. 4 is a side elevation view of a first embodiment wedge element of the invention.
Figure 5:
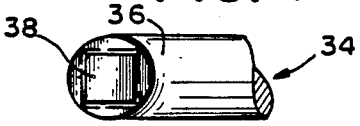
FIG. 5 is a partial top plan view of the first embodiment wedge element of FIG. 4.

In the splitting configuration depicted in FIGS. 1 and 2, the tool 10 includes a first wedge element 34, depicted in greater detail in FIGS. 4 and 5. Referring to those figures, the first wedge element 34 includes a body portion 36 and a protruding stud portion 38. The first recess 30 (FIG. 3) is configured to matingly receive and removably retain the stud portion 38 of the first wedge element 34 while the stud portion 38 is itself configured to be and is matingly received and removably retained in the first recess 30, at least sufficiently to use the tool 10 for splitting material like wood. The stud portion 38 connects the first wedge element 34 at least generally non-movably to the head 12 protruding from the one side face 24. In this embodiment, both the stud portion 38 and first recess 30 have square cross sections, symmetrically shaped and oriented with respect to one another. The four planar surfaces providing the square cross section of the first recess 30 are parallel to and at least closely adjoin if not contact the four planar surfaces of the stud portion 38 sufficiently to prevent rotation of the stud portion 38 in the first recess 30. Preferably, the outer dimensions of the stud portion 38 are also so close to the inner dimensions of the first recess 30 that the stud portion 38 frictionally engages the surfaces of the first recess 30, at least when the stud portion 38 is being moved in the first recess 30. The stud portion 38 is also sufficiently long to extend at least through the central plane 28 and preferably to the opposing side face 26 both for strength and for the ability to configure the stud portion 38 and/or the first recess 30 for securing the two together either at the middle of the recess or at the ends of the stud portion 38 proximal to or distal to the body portion 36.

Referring to FIG. 4, the body portion 36 of the first wedge element 34 has outer surface 40 for splitting material which is generally inclined from a base portion 41 which rests against the side face 24 in the second recess 32. Preferably, outer surface 40 is generally convexedly outwardly curved in a longitudinal direction between the base portion 41 and the wedge portion 38 as well as in an axial direction of the body portion, perpendicular to the longitudinal direction. The body portion 36 is generally curved with the surface of the body portion 36, which is opposite the outer surface 40 and facing the one major side face 24, generally concavely curved so that the generally concavely curved surface and the body portion are generally spaced away from the one major side face 24 along the one end between the base portion 41 and the wedge portion 38. The body portion 36 preferably extends from the stud portion 38 to an opposing end 42 of the first wedge element 34. The opposing end 42 is also the leading end of the first wedge element 34, located closest to the cutting edge 16, when the first wedge element 34 is mounted to the head 12 (FIGS. 1 and 2). The stud portion 38 protrudes outwardly from the body portion 36 in a direction transverse to the incline of the outer surface 40 and to the base portion 41 and generally opposite to the outward convexity of the outer surface 40. The stud portion 38 and the body portion 36 are preferably fixedly joined for strength and to prevent relative movement between the two. Preferably, the stud portion 38 and the body portion 36 are formed from a single piece of material, such as steel, which is sized, shaped and otherwise configured so as to withstand impacts against the outer surface 40 from at least one direction transverse to the outwardly protruding direction of the stud portion 38 when first wedge element 34 is mounted by the stud portion 38 to a side face of the head of a chopping tool, as is the stud portion 38 matingly received in the first recess 30 of head 12. It is noted that the curvature of the outer surface 40 is neither uniformly circular nor sharply radiused at any intermediate point. Rather, the outward convexity of the outer surface 40 is preferably generally exponentially shaped, having a curvature the radius of which generally increases as the body portion extends from the stud portion 38 to the leading end 42 of the body portion 36. While such a shape is preferred, other shapes including a single radius curve between essentially straight portions of the outer surface 40 and even a straight outer surface may be used.

Referring to FIG. 3, the second recess 32 preferably is shallower than the first recess 30 and receives the leading end 42 (FIG. 4) of the first wedge element 34 and recesses the leading end 42 beneath the surrounding surface of the side face 24 to shield the extreme forward edge of the leading end 42 from direct impact while the tool 10 is being used. Such impact might tend to lift the leading end 42 from the side face 24 and twist or break the first wedge element 34, were the leading end 42 not to be recessed. Impact forces on the outer surface 40 are resolved into a normal component which tends to force the first wedge element 34 against the side face 24 and a tangential component which tends to force the first wedge element 34 backwards towards the handle 22. Preferably, the first and second recesses 30 and 32 are located between the blade end 14 and eye hole 18 and are spaced from one another, preferably aligned generally perpendicular to the axial direction of the eye hole 18, as is indicated in FIG. 3 by line 44 intersecting the first and second recesses 30 and 32 and generally perpendicular to axis 20 representing the axial direction of the eye hole. Preferably, the first recess 30 is a hole extending entirely through the head 12 as is depicted in FIG. 2 so that the first wedge element 34 may be mounted to either side face 24 and 26 of the head 12. Preferably too, another recess 46, substantially symmetric to the second recess 32 is symmetrically positioned on the other side face 26 (FIG. 2) and sized to receive and recess the leading portion of the first wedge element 34, when that element is applied to the other side face 26, as might be preferred by a left-handed user of the tool 10.

Preferably, the leading end 42 is spaced between about one-half and three-quarters of an inch from the cutting edge 16 to provide a splitting action like that provided by the splitting ax invention disclosed in U.S. Pat. No. 4,586,258.

Figure 2A:
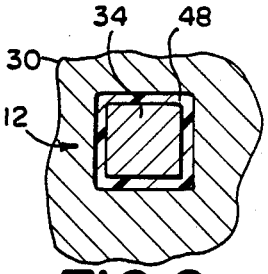
FIG. 2*a* depicts a slightly modified version of the embodiment of FIGS. 1–2 along lines *2a—2a*.

Because of the protection to the leading end 42 of the first wedge element 34 provided by the second recess 32, the impact forces received by the first wedge element 34 are carried by the stud portion 38 and the first recess 30. Consequently, smaller forces are needed to merely retain the stud portion 38 in the first recess 30. An embodiment like that shown in FIGS. 1–3 has been successfully used with nothing more than the fit and friction between the first recess 30 and stud portion 38 holding the first wedge element 34 to the tool head 12. The first wedge element 34 was shaped from part of a steel chain link slightly more than about one-half inch thick, with a stud portion having a square cross-section slightly less than about onehalf inch on a side and extending substantially entirely through the ax between the side faces. However, one of ordinary skill will appreciate frictional engagement between the stud portion 38 and the recess 30 can be enhanced in various conventional ways. For example, the first recess 30 may taper inwardly slightly from each of the side faces 24, 26 and/or the stud portion 38 may taper slightly inwardly as the stud portion 38 protrudes from the body portion 36 to assure eventual contact between walls of the stud portion 38 and surfaces of the head forming the first recess 30. Also, the stud portion 38 may be split and/or be otherwise constructed to expand or be expanded to enhance the frictional engagement or otherwise removably secure the stud portion in the recess. Also, other softer, more pliable and even elastic materials such as fabric, fiber, caulk, adhesive, rubber, plastic, solder, etc. may be interposed in a conventional fashion between the stud portion 38 and the first recess 30 as means for securing the stud portion in the recess by increasing the frictional force on the stud portion 38 and/or by removably bonding the stud portion 38 to the head. For example, FIG. 2a illustrates diagrammatically a separate material such as a layer of silicone rubber caulk 48 located between the stud portion 38 and the first recess 30. It is further noted that by extending the stud receiving first recess 30 through the head 12 these other materials may be applied from side face opposing the first wedge element 34. The invention is intended to cover all means of securing the wedge element to the head which permit disassembly and replacement of the wedge element without damage to the tool head.

Figure 6:
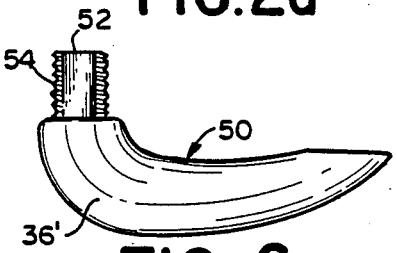
FIG. 6 is a side elevation view of a second embodiment wedge element of the invention.
Figure 7:
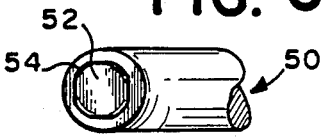
FIG. 7 is a partial top plan view of the second embodiment wedge element of FIG. 6.
Figure 8:
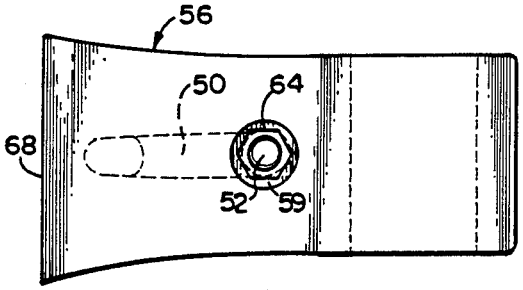
FIG. 8 is a side elevation view of a second embodiment hand tool head configured for splitting.
Figure 9:
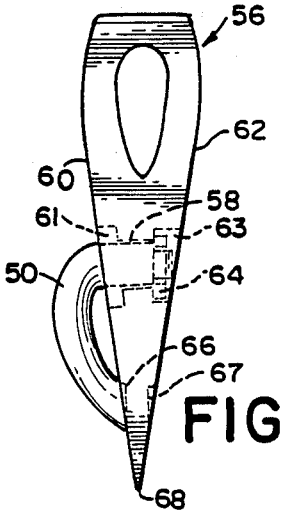
FIG. 9 is a top plan view of the head of FIG. 8.

Some other, conventional, mechanical securing means for removably retaining a splitting wedge element in the head of a chopping tool are shown in FIGS. 6 through 13. In FIGS. 6 and 7, a second embodiment second wedge element 50 is depicted having a stud portion 52, generally square in cross section, with corner threading 54. The body portion 36' is substantially identical in size and shape to body portion 36 of FIGS. 4–5. One method of mounting the second wedge element 50 is depicted with respect to FIGS. 8 and 9. There the head 56 of a conventional chopping tool such as an ax, hatchet or the like is again provided with a first recess 58 (see FIG. 9) in the form of a bore having a generally square cross section extending from a first side face 60 to a second side face 62. The first recess 58 is counterbored at 61 on the first side face 60 and at 63 on the second side face 62 to permit a nut 64 to be attached to the threaded end of the stud portion 52 securing the second wedge element 50 to either side face 60 and 62 of the head 56 in a non-rotatable, generally otherwise non-movable manner. Again, second and third recesses 66 and 67 (FIG. 9, in phantom) are preferably provided on the first and second side faces 60 and 62 to receive a leading portion of the second wedge element 50 closest to the cutting blade 68 at the end of the head 56.

Figure 10:
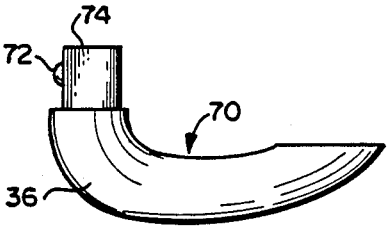
FIG. 10 is a side elevation of a third embodiment wedge element.
Figure 11:
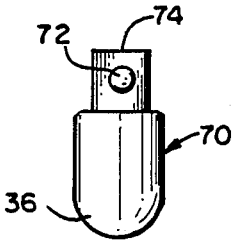
FIG. 11 is an elevation view of the left end of the wedge element of FIG. 10.
Figure 13:
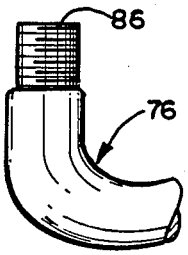
FIG. 13 is a partial side elevation view of a fourth wedge element embodiment intended to be used with the head of FIG. 12.

FIGS. 10 and 11 depict a third embodiment wedge element 70 differing from the first wedge element 34 of FIGS. 4 and 5 by the addition of a latching member 72 extending generally transversely from the stud portion 74 of the third wedge element 70. The latching member 72 may be a ball bearing or pin biased outwardly by a spring (not depicted) and is designed to seat in a depression or groove in a surface of the recess (neither depicted) receiving the stud portion 74 of the third wedge element 70, for example, a recess at the central plane of the tool head, for mounting the third wedge element 70 to either side face of the head.

Figure 12:
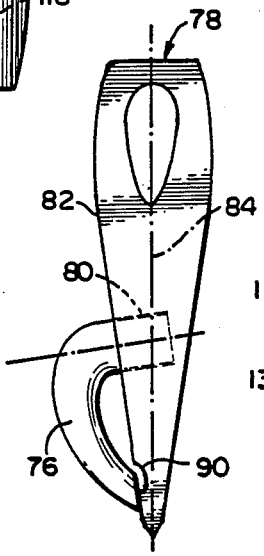
FIG. 12 is a top plan view of a third tool head embodiment configured for splitting.

FIG. 12 depicts a suggested mounting of a fourth embodiment wedge element 76 in the head 78 of a hand tool for chopping The head 78 of FIG. 12 differs from the head 12 of FIGS. 1 through 3 only with respect to the recesses A first recess 80 is provided in head 78 extending into a first side face 82 at an angle which is generally perpendicular to side face 82 and not perpendicular to a central plane 84 of the head 78. The first recess 80 is threaded to receive the threaded cylindrical stud portion 86 of the fourth embodiment wedge element 76, partially depicted in FIG. 13. The threaded cylindrical stud portion 86 of the fourth wedge element 76 is simply threaded into the first recess 80. Preferably, a second recess 90 in the form of a depressed circular arc across the side face 82 may be provided to receive the leading portion of the fourth wedge element 76.

Also, one of ordinary skill will appreciate that, in addition to those already described and suggested, any of a variety of other means might be used for removably retaining the stud portion in the recess, including systems already used for coupling tools with heads and/or handles, such as the latching systems employed in Snap-On TM tools and others, known to those of ordinary skill in the hand tool art.

The asymmetric mounting of a single wedge element to only one of the two side faces of the tool head, such as the embodiments of FIGS. 1–2, 8–9 and 12, is preferred for simplicity and effectiveness. It has been found that such a mounting provides the same type of effective splitting action as does an asymmetrically formed tool head, like that described in U.S. Pat. No. 4,586,258 and others.

Figure 14:
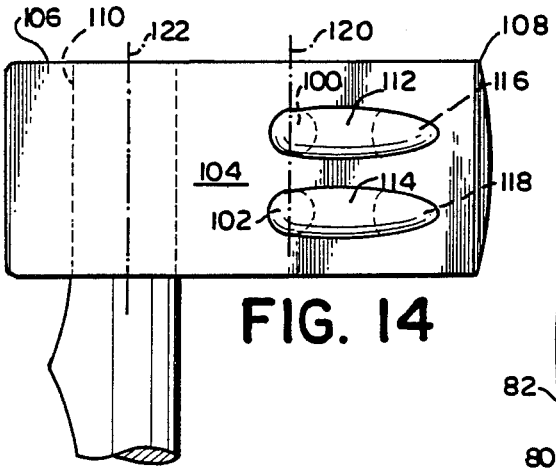
FIG. 14 is a side elevation view of a fourth tool head embodiment configured for splitting.
Figure 15:
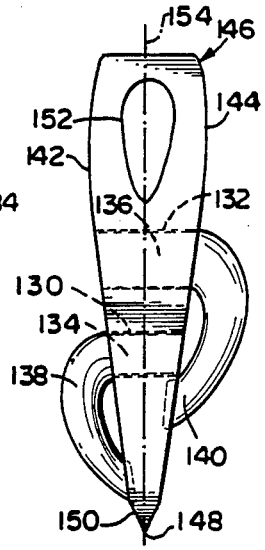
FIG. 15 is a top plan view of a fifth tool head embodiment configured for splitting.

Numerous other variations of the invention are possible, two more of which are specifically illustrated. As is depicted in FIGS. 14 and 15, it may be desirable to mount plural wedge elements to the head of a heavier tool. FIG. 14 is an example of one type of mounting wherein first and second recesses 100 and 102 (both in phantom) are provided in one side face 104 of a tool head 106 between the blade end 108 and an eye hole 110 (also indicated in phantom) of the tool head 106. Each of the first and second recesses 100 and 102 receives a protruding stud portion (not depicted) of one of first and second wedge elements 112 and 114, respectively. First and second wedge elements 112 and 114 may be of any wedge element construction already disclosed or suggested or any other construction. The stud portions of the first and second wedge elements 112 and 114 are generally non-movably secured in the respective first and second recesses 100, 102, so that the first and second wedge elements 112, 114 protrude from the one side face 104 of the tool head 106. Preferably again, additional recesses 116 and 118 (both in phantom) are provided for receiving the leading end portion of each of the first and second wedge elements 112 and 114, respectively. In FIG. 15, first and second recesses 130 and 132 are provided for receiving stud portions 134 and 136 (all in phantom) of first and second wedge elements 138 and 140, respectively. Again, the stud portions 134 and 136 are removably received in the first and second recesses 130, 132, respectively and at least generally non-movably secure the first and second wedge elements 138 and 140 to opposing side faces 142 and 144, respectively, of the head 146 between a cutting edge 148 at a blade end 150 of the head 146 and an eye hole 152 of the head 146. The first and second recesses 100 and 102 of the embodiment of FIG. !4 are located on the same side face 104 and lie along a line 120 generally parallel to an axial direction of the eye hole 110 indicated by line 122. In FIG. 15, the first and second recesses 130 and 132, respectively, receiving the wedge elements 134, 136 are spaced from each other in a direction in a central plane 154 of the head 146, bisecting the cutting edge 148 and eye hole 152, generally perpendicular to an axial direction of the eye hole 152 which is perpendicular to the plane of the figure.

While various embodiments of the invention have been described and variations thereto suggested, still other variations will occur to those of ordinary skill in this art. The tool heads of the various embodiments shown in the figures have had opposing side faces generally symmetric with respect to the central plane of the head, preferably for ease of manufacture of the tool head. However, it is not a requirement that such surfaces be symmetric. Also, in each of the depicted embodiments, the wedge means have been asymmetrically mounted to the tool head either by mounting the wedge element or elements to only one side face of the tool head or by spacing wedge elements from one another on opposing side faces of the tool head, in the manner shown in FIG. 15. In all of the asymmetric mountings, wedge means (one or two wedge elements) are removably attached to a head protruding from one of the side faces between the cutting edge and the eye hole while the other side face lacks wedge means positioned symmetrically with respect to the wedge(s) mounted on the one side face. While such asymmetric mounting is preferred to achieve the same splitting action as the tool described in the aforementioned U.S. Pat. No. 4,586,258, asymmetric mounting of the wedge elements is not required for use of the tools being described and applicant's invention includes any such hand tool which may be converted for chopping and splitting by the removable mounting of one or more generally immovable wedge elements to one or both side faces of such a tool head. Accordingly, it should be understood that this invention is not limited to the particular embodiments disclosed, but is intended to cover any modifications which are within the scope and spirit of the invention as defined by the appended claims.

I claim:

1. A hand tool convertible for chopping and splitting comprising:

a head having a blade end with a cutting edge, an eye hole extending in an axial direction through the head for receiving a handle, a pair of opposing major side faces extending from the cutting edge around and past the eye hole, and a recess extending into at least one of the pair of side faces; and wedge element including a body portion and a protruding stud portion, the stud portion being removably retained in the recess and at least generally, non-movably connecting the wedge element to the head, the body portion being generally curved at one-end and having an outer surface at least generally curved at the one end of the body portion to curvingly bulge outwardly from the one side face and a generally concavely curved surface at the one end opposite the outer surface whereby the generally concavely curved surface and body portion at the one end are spaced outwardly from the one side face.

2. The hand tool of claim 1 wherein the stud portion is generally symmetrically shaped with respect to the recess and frictionally engages the head in the recess.

3. The hand tool of claim 1 wherein the recess and the stud portion are configured for preventing rotation of stud portion in the recess.

4. The hand tool of claim 1 further comprising securing means for removably securing the stud portion in the recess.

5. The hand tool of claim 4 wherein the securing means comprises threads on the stud portion.

6. The hand tool of claim 4 wherein the securing means comprises latch means for latching the head and stud portion together.

7. The hand tool of claim 4 wherein the securing means comprises a separate material located in the recess between the head and the stud portion.

8. The hand tool of claim 1 further comprising:

another recess in one of the pair of side faces; and another wedge element including a protruding stud portion removably retained in the other recess and at least generally non-movably connecting the other wedge element to the head protruding from the side face of the head.

9. The hand tool of claim 8 wherein the two wedge elements are located on the same side face of the head.

10. The hand tool of claim 8 wherein the two wedge elements are located asymmetrically on opposite side faces of the head.

11. The hand tool of claim 1 wherein the head is a chopping hand tool head.

12. A wedge element adapted for attachment to a side face of a head of a chopping hand tool for conversion of the tool from chopping to splitting comprising:

a body portion having an outer surface, the outer surface being at least generally curved at one end of the body portion to curvingly bulge outwardly from the side face for splitting material;

a stud portion protruding outwardly from the body portion in a direction generally opposite a direction of the outward bulging of the outer surface;

the body portion being generally curved at the one end and including a generally concavely curved surface opposite the outer surface at the one end whereby the body portion and the generally concavely curved surface are spaced outwardly from the one side face when the wedge element is mounted to the head; and the wedge element being constructed so as to withstand impacts against the outer surface from at least one direction transverse to the outwardly protruding direction of the stud portion when the wedge element is mounted by the stud portion to a side face of the head of the chopping tool.

13. The wedge element of claim 12 wherein the outer surface has a generally exponentially shaped outward convexity.

14. The wedge element of claim 12 wherein the body portion and the stud portion are formed from a single piece of metal.

15. In a head for a hand tool for chopping having a blade end with a cutting edge, an eye hole extending in an axial direction through the head for receiving a handle, a pair of opposing major side faces extending from the cutting edge around and past the eye hole, a central plane extending between the pair of side faces and bisecting the cutting blade and the eye hole, an improvement for converting the hand tool to splitting, the improvement comprising first and second recesses extending into at least one of the pair of side faces, the first and second recesses being spaced from one another at least in a direction generally perpendicular to the axial direction of the eye hole, the first recess being closer to the eye hole and the second recess being closer to the cutting edge, the first recess being deeper than the second recess and being configured to matingly receive and removably retain a stud portion of a wedge element for at least generally non-movable connection of the wedge element to the one side face of the head by insertion of the stud portion into the first recess, and the second recess being configured to receive and recess a leading end portion of the wedge element located closest to the cutting edge.

16. The improvement of claim 15 further comprising a third recess extending into the head on the one major side face and being shaped like the first recess to matingly receive and generally removably retain a stud portion of another wedge element, the first recess and the third recess intersecting a line roughly parallel with the axial direction of the eye hole.

17. The improvement of claim 15 further comprising a third recess extending into the other side face and being shaped like the first recess to matingly receive and generally removably retain a stud portion of another wedge element, the first recess and the third recess intersecting a line roughly perpendicular with the axial direction of the eye hole.

18. The improvement of claim 15 wherein the first recess includes a notch in a surface of the head forming the recess for securing the wedge element to the head.

19. The improvement of claim 18 wherein the first recess is a hole extending between the two side faces and the notch is formed by countersinking of the first recess hole on the other side face of the head.

20. The improvement of claim 15 wherein the first recess is at least partially threaded.

21. A hand tool for splitting comprising:

a head including a blade end with a cutting edge, an eye hole extending in an axial direction through the head for receiving a handle, and a pair of opposing major side faces extending from the cutting edge around and past the eye hole; and wedge means removably attached to the head, the wedge means including a body portion with an outer surface at least generally curved at one end of the body portion to curvingly bulge outwardly from one of the side faces between the cutting edge and the eye hole from a position adjoining the cutting edge, the body portion being generally curved at the one end and further including a generally concavely curved surface opposite the outer surface and facing the one side face whereby the generally concavely curved surface and body portion at the one end are spaced outwardly from the one side face; and the other side face lacking additional removable wedge means.

22. A hand tool convertible for chopping and splitting comprising:

a head having a blade end with a cutting edge, an eye hole extending in an axial direction through the head for receiving a handle, a pair of opposing major side faces extending from the cutting edge around and past the eye hole, and a recess extending into at least one of the pair of side faces;

a wedge element including a protruding stud portion, the stud portion being removably retained in the recess and at least generally, non-movably connecting the wedge element to the head protruding from the one side face; and another recess in the one side face; and another wedge element including a protruding stud portion removably retained in the other recess and at least generally non-movably connecting the other wedge element to the head protruding from the one side face whereby the two wedge elements are located on the same one side face of the head.

* * * * *